US005353677A

United States Patent [19]

Kennedy

[11] Patent Number: 5,353,677

[45] Date of Patent: Oct. 11, 1994

[54] SHOCK ISOLATION SYSTEM

[75] Inventor: Robert E. Kennedy, Scotts Valley, Calif.

[73] Assignee: Westinghouse Electric Corporation, Pittsburgh, Pa.

[21] Appl. No.: 114,884

[22] Filed: Aug. 31, 1993

[51] Int. Cl.[5] ..... F41F 3/04

[52] U.S. Cl. ..... 89/1.816; 89/1.8

[58] Field of Search ..... 89/1.816, 1.81, 1.809, 89/1.817, 1.819

[56] References Cited

U.S. PATENT DOCUMENTS

| | | | |
|---|---|---|---|
| 3,124,040 | 3/1964 | Fiedler | 89/1.816 |
| 3,135,162 | 6/1964 | Kamalian | 89/1.81 |
| 3,160,061 | 12/1964 | Moy | 89/1.816 |
| 3,289,533 | 12/1966 | Brown | 89/1.81 |
| 3,857,321 | 12/1974 | Cohen | 89/1.816 |
| 4,464,972 | 8/1984 | Simon | 89/1.816 |
| 4,604,940 | 8/1986 | Mendelsohn et al. | 89/1.816 |
| 4,756,226 | 7/1988 | Presik | 89/1.816 |

*Primary Examiner*—David Brown

[57] ABSTRACT

In a canister carrying a missile having two stages of different diameters, flexible pads are provided to cushion the smaller diameter stage of the missile. The pad is a relatively flexible elastomer folded over on itself which, when the missile is fired, unrolls to a stowed position to allow passage of the larger diameter first stage of the missile.

11 Claims, 5 Drawing Sheets

SHOCK ISOLATION SYSTEM

BACKGROUND OF THE INVENTION

Field of the Invention

The invention in general relates to an arrangement for mitigating shock in container carried structures, and particularly, a shock absorbing arrangement for a missile within a launch canister.

Background Information

Shock absorbing pads are used in missile launch canisters to protect the missile during transportation and in setting up prior to launching. For missiles having a uniform diameter, shock absorbing pads may be placed along the inside of the launch canister for the entire length of the missile. For missiles which have multiple stages of different diameters, however, any shock absorbing pads which cushion the smaller diameter stage would block passage of the larger diameter stage or stages.

One typical solution is to utilize flyout pads which are ejected during the launch. However, there are some operational situations which limit launch debris and which would preclude the use of flyout pads.

The present invention provides a solution to the problem of adequately cushioning a multistage missile by maintaining the smaller diameter shock isolation devices within the canister during and subsequent to a launch.

SUMMARY OF THE INVENTION

The present invention is used in a shock isolation system for a structure having at least a first cylinder and a second cylinder of a smaller diameter with both cylinders having a common longitudinal axis and being adapted for axial movement in a container, with the second cylinder leading. A flexible elastomeric pad is provided and is adapted to be folded over on itself and is coupled to the container and positioned to contact and cushion the second cylinder during periods of non-axial movement. The folded over portion of the pad is in the travel path of the first cylinder and is constructed and arranged to unroll when contacted by the first cylinder during travel so as to allow passage of the first cylinder.

To facilitate the unrolling, the folded over portion of the pad includes a plurality of notches and the unrolling action may further be aided with a relatively high friction coating on the portion of the pad which contacts the second cylinder and a relatively low friction coating on the portion of the pad which is folded over on itself.

BRIEF DESCRIPTION OF THE DRAWINGS

FIG. 7 illustrates a portion of the pad in somewhat more detail;

FIG. 8 illustrates a front view of the pad and its positioning relative to guide rails.

DESCRIPTION OF THE PREFERRED EMBODIMENT

Figure 1:
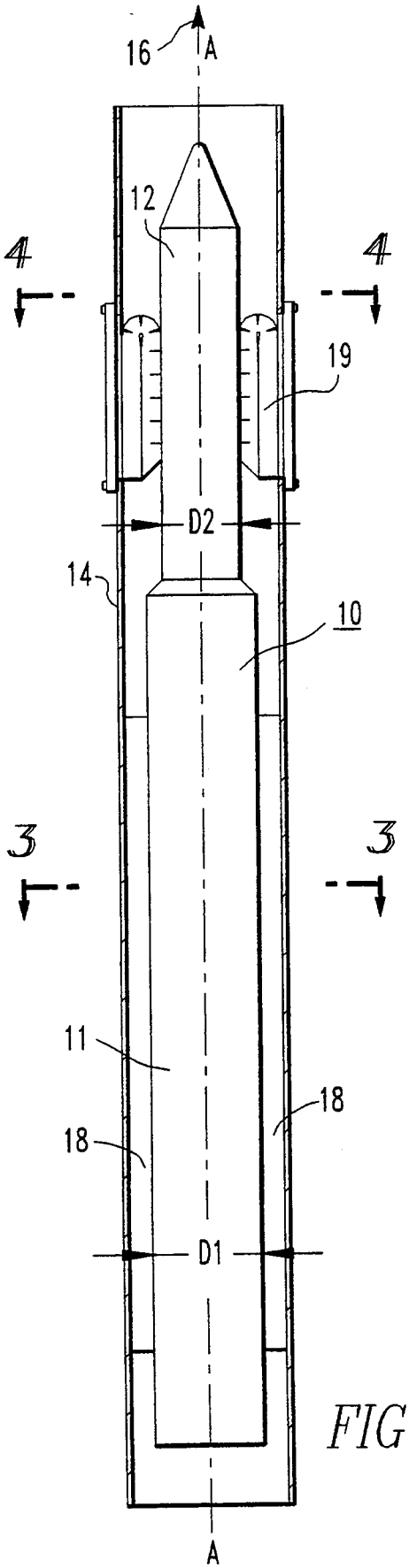
FIG. 1 is a schematic illustration of a two-stage missile within a container.

The invention will be described by way of example with respect to a missile system such as illustrated in FIG. 1. The missile 10 includes first and second cylindrical stages 11 and 12 having a common axis AA and having respective diameters D1 and D2, where D1 is greater than D2.

The missile is positioned within a container 14 which may be used for transportation purposes. When set up at a launch site, the container 14 functions as a launch canister for the missile which is launched in the direction of arrow 16, with the second stage 12 leading.

In order to cushion the missile during transportation, handling and set up prior to launching, shock isolation arrangements 18 and 19 are provided for the first and second stages respectively.

Figure 2:
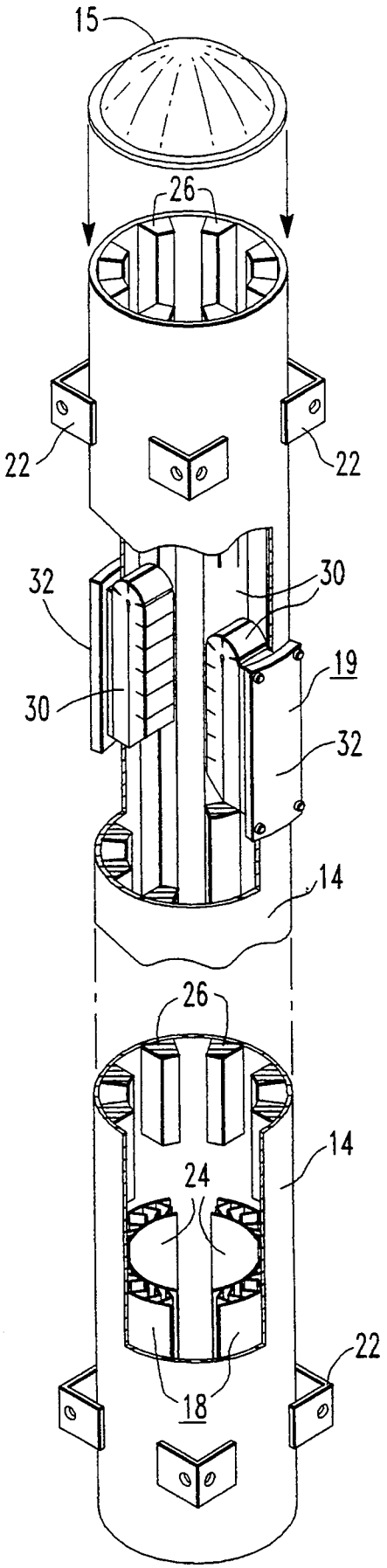
FIG. 2 is a more detailed view of the container, without the missile, with a portion broken away to illustrate the inside of the container.

The canister, illustrated in somewhat more detail in FIG. 2, includes brackets 22 utilized in transporting the canister launch platform interface, and for coupling multiple canisters together, if required.

Figure 3:
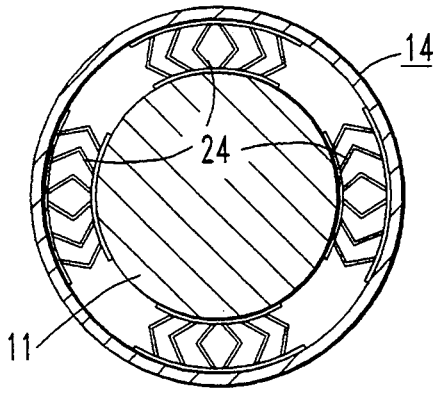
FIG. 3 is a cross-sectional view along lines III—III of FIG. 1.

The first shock isolation arrangement 18 is comprised of a plurality of supports 24 positioned around the first stage of the missile such as illustrated in the view of FIG. 3 wherein the first stage of the missile is represented by the cross-hatched circle. Such supports are well known and may be comprised of a relatively stiff polyurethane elastomer molded into a series of chevron-shaped struts such as described in U.S. Pat. Nos. 4,646,617; 4,604,940; and 4,406,211, by way of example.

Referring once again to FIG. 2, extending from the shock isolation arrangement 18 is a plurality of guide rails 26 arranged in pairs around the inside of the canister 14 and being functional to limit radial movement of the first stage of the missile during a launch.

The second shock isolation arrangement 19, as will be further described, includes a relatively flexible elastomeric pad 30 folded over on itself and in the folded over position contacts and cushions the second stage of the missile for shock isolation purposes. In one embodiment, each pad 30 is connected to a respective plate 32 which in turn is connected to and forms a part of the canister 14.

Figure 4:
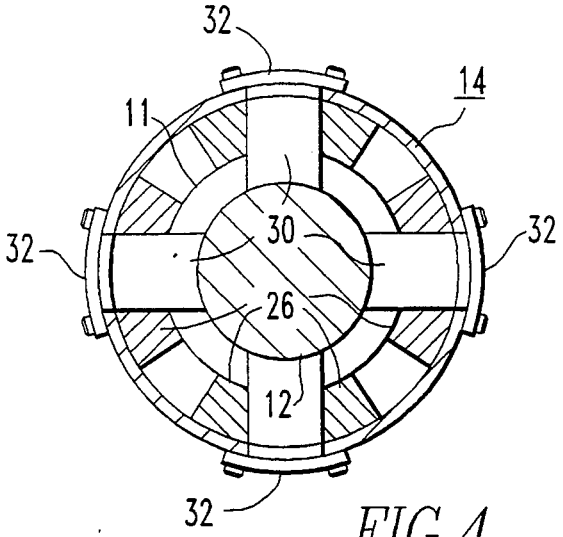
FIG. 4 is a cross-sectional view along lines IV—IV of FIG. 1.

At least three such pads are used around the circumference of the first stage of the missile, and as illustrated in FIG. 4, four such pads are utilized and positioned in diametrically opposed locations to cushion the first stage as represented by the cross-hatched circle. FIG. 4 additionally illustrates the positioning of each pad 30 between respective pairs of guide rails 26.

Figure 5:
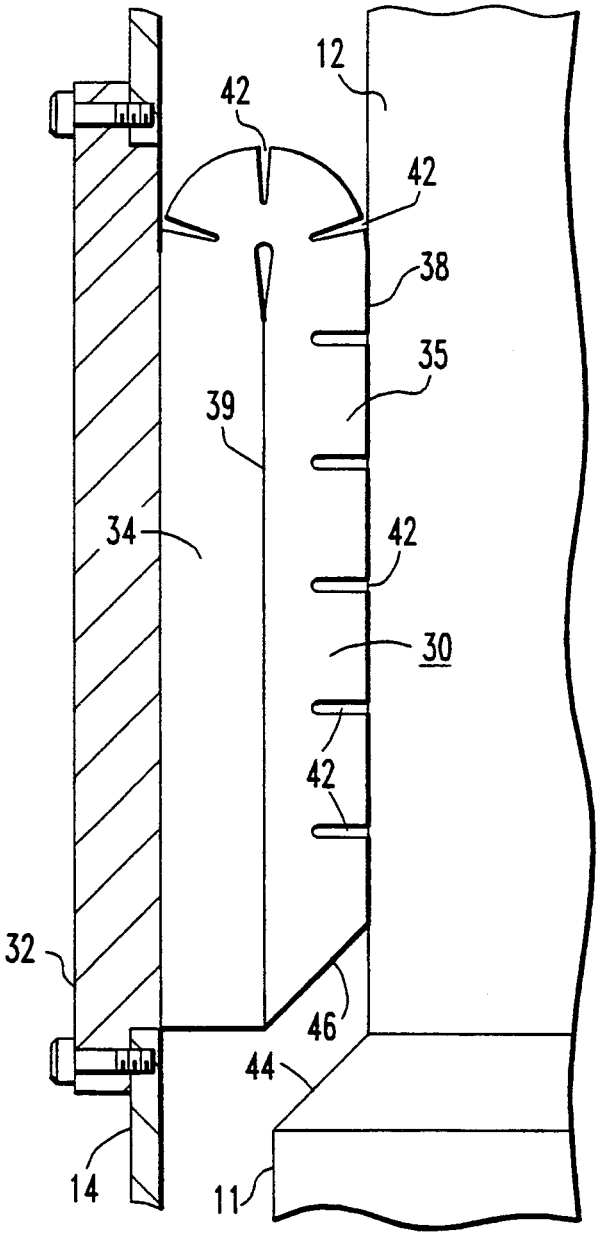
FIG. 5 is a schematic side view of the cushioning pad used within the container.

The pad 30, illustrated in more detail in FIG. 5, includes a first portion 34 coupled to the canister 14 and a folded over portion 35 which contacts the second stage 12 of the missile.

In a preferred embodiment, surface 38 which contacts the missile is laminated or coated with a high friction material such as a surfacing compound with particulate material, with the friction being enhanced by a predetermined compression of the pad 30. Surface 39 which contacts itself in the folded position preferably is laminated or coated with a relatively low friction material such as polytetrafluoroetheleyne. The folded over portion 35 is serrated by means of a plurality of notches 42 of sufficient depth to provide relief to facilitate unrolling of the pad when the missile is launched.

Figure 6C:
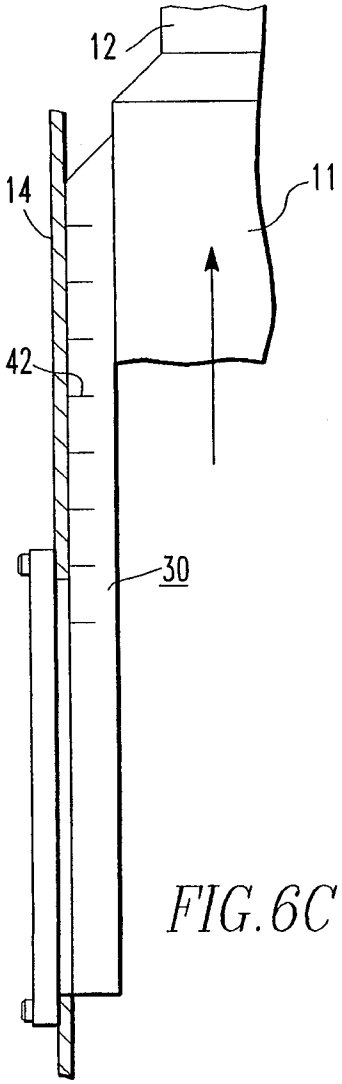
FIGS. 6A–6C illustrate the unrolling of the pad during a missile launch.
Figure 6B:
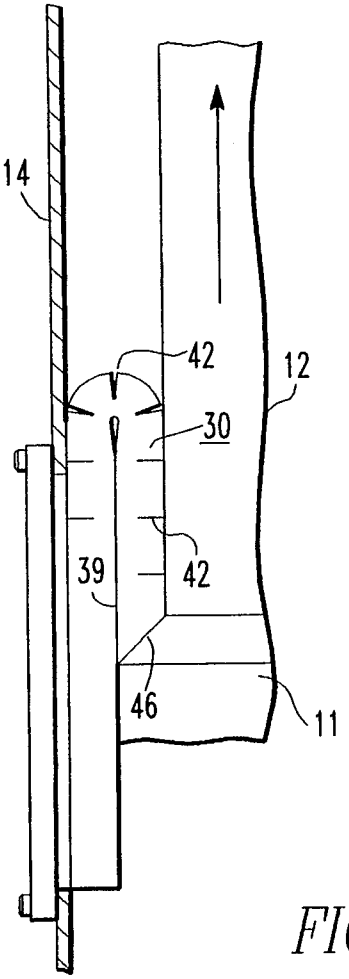
Figure 6A:
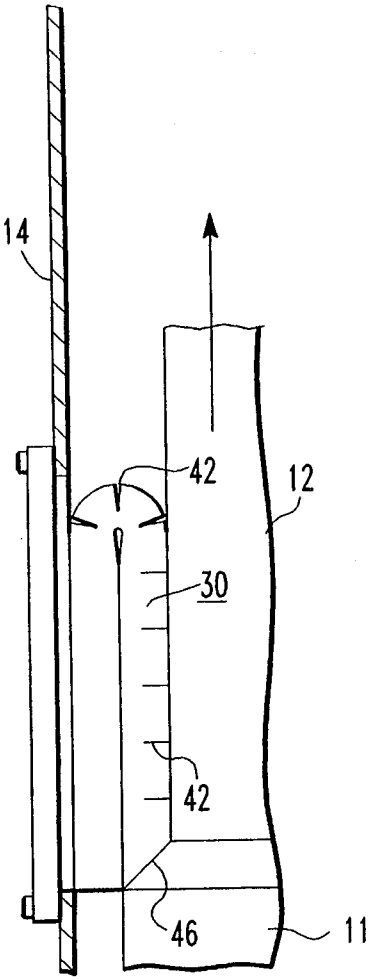

Due to the different diameters of the first and second stages of the missile, the missile includes a conical transition member 44 having a certain slope. If the shock isolation arrangement is such that the pad 30 is located proximate the transition member 44, or if no high friction material is provided on surface 38, then the end 46 of the pad 30 may be provided with a relatively hard sloping surface 46 at an angle to match that of the transition member 44 to provide a hard contact surface, if required, for actuation by the leading edge (the transition member) of the larger diameter first stage 11. FIGS. 6A–6C illustrate the unrolling process of the pad 30 during a launch. In FIG. 6A, the larger diameter first stage 11 contacts the beveled end 46 of the pad 30 to initiate its unrolling although such unrolling may be initiated merely by the high frictional engagement of the pad with the second stage 12 of the missile. As the missile proceeds along its axial direction, the pad 30, facilitated by notches 42, unrolls into a final position as illustrated by FIG. 6C to allow passage of the larger diameter first stage 11.

FIG. 7 illustrates a portion of the pad 30 in somewhat more detail. In FIG. 7 there is illustrated a plurality of wedges 50 formed on the side of the pad 30. A similar series of wedges could also be provided on the other side of the pad 30. With additional reference to FIG. 8, each pad is located between a pair of guide rails 26. As the pad unrolls, it is forced between the guide rails and the provision of wedges 50 will ensure that the pad will be forced into position between the guide rails, as it unrolls, and will be retained there by the wedging action.

Figure 11:
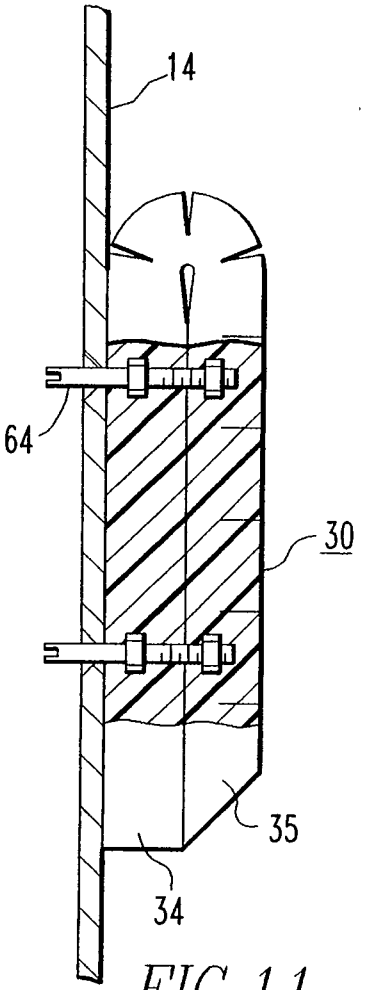
FIGS. 9, 10 and 11 illustrate different embodiments for attaching the pad to the canister.
Figure 10:
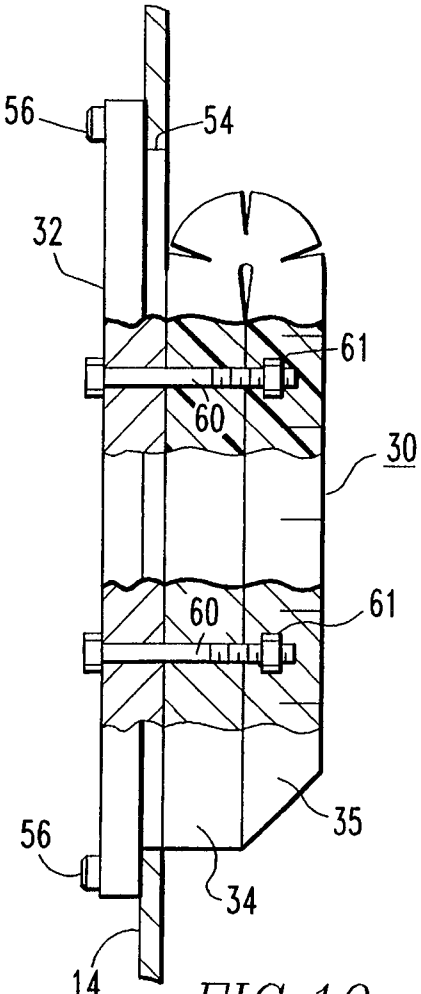
Figure 9:
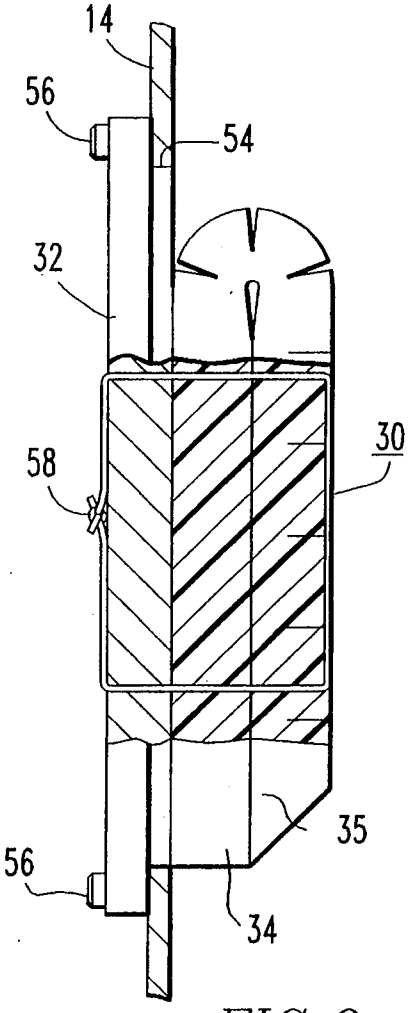

FIGS. 9, 10 and 11 schematically illustrate various methods by which the pads 30 may be installed.

In FIG. 9, portion 34 of pad 30 is bonded to plate 32 which is inserted through an aperture 54 in canister 14 and is secured thereto by means of, for example, bolts 56. Pad 30 is maintained in its folded over position by means of a wire or string 58 which may be cut and removed after the missile is in place and after which the wire holes in plate 32 would be suitably sealed.

FIG. 10 illustrates another external mounting, however, in place of string 58, the pad is held in its folded over condition by means of screws 60 which pass through portion 34 and engage with nuts 61 embedded in the folded over portion 35. After placement of the missile, the screws may be removed and the screw holes in plate 32 sealed.

FIG. 11 illustrates a mounting method which does not utilize placement through an aperture but rather, portion 34 of pad 30 is directly bonded to the inside of container 14. The folded over condition of the pad 30 is maintained utilizing retaining screws 64 engaging nuts 65 embedded in both portions 34 and 35 of pad 30. With the embodiments of FIGS. 9 and 10, the missile may be loaded in to the canister from either the front or rear and the pads put into place after missile loading. In the embodiment of FIG. 11, with the direct bonding to the canister wall, the missile is loaded from the rear of the canister. After loading, the retaining screws 64 may be removed after which the holes in the canister 14 may be sealed.

I claim:

1. In a shock isolation system for a structure having at least a first cylinder and a second cylinder of a smaller diameter, both having a common longitudinal axis and being joined by a conical transition member and adapted for axial movement in a container, with the second cylinder leading, the improvement comprising:

a) a flexible elastomeric pad adapted to be folded over on itself and being coupled to said container and positioned to contact and cushion said second cylinder during periods of non-axial movement;

b) the folded over portion of said pad being in the travel path of said first cylinder and being adapted to unroll when contacted by said first cylinder during said travel to allow passage of said first cylinder.

2. Apparatus according to claim 1 wherein:

a) said folded over portion of said pad includes a plurality of notches therein to facilitate said unrolling.

3. Apparatus according to claim 1 wherein:

a) the portion of said pad which contacts said second cylinder has a relatively high friction coating thereon;

b) the portion of said pad which is folded over on itself has a relatively low friction coating thereon.

4. Apparatus according to claim 1 wherein:

a) said pad includes a sloping end portion having a slope matching the slope of said transition member.

5. Apparatus according to claim 1 which includes:

a) at least three of said pads disposed around the inside of said container.

6. Apparatus according to claim 1 wherein:

a) said container is a launch container for said missile.

7. Apparatus according to claim 1 wherein:

a) at least three of said pads are disposed around the inside of said container;

b) the non folded over portion of each said pad being bonded to respective plate members;

c) said container including at least three apertures around the periphery thereof;

d) each said pad being inserted through a respective one of said apertures;

e) each of said plate members being connected to said container.

8. Apparatus according to claim 7 wherein:

a) at least three of said pads are disposed around the inside of said container;

b) said pads being bonded directly to the inside of said container.

9. Apparatus according to claim 1 which includes:

a) shock isolation means arranged about said first cylinder;

b) a plurality of guide rails extending from said shock isolation means longitudinally along the inside of said container for limiting radial movement of said first cylinder during said axial movement.

10. Apparatus according to claim 9 wherein:

a) said pad is disposed between two adjacent ones of said guide rails.

11. Apparatus according to claim 10 wherein:

a) said pad includes side wall portions having projections thereon which contact said adjacent guide rails as said pad unrolls;

b) said unrolled pad being held in position by wedging action of said projections against said adjacent guide rails.

* * * * *